US005542278A

United States Patent [19]

Aleksandrovich et al.

[11] Patent Number: 5,542,278

[45] Date of Patent: Aug. 6, 1996

[54] METHOD OF RADIAL FORGING

[76] Inventors: Tjurin V. Aleksandrovich, Trofimov Str. 9/117, 112321 Moscow; Kuroles V. Ivanovich, Planernaya Str. 12/1/255, 123481 Moscow, both of Russian Federation; Lazorkin V. Andreyevich, Zadneprovskaya Str. 16a/100, 330096 Zaporozhye, Ukraine; Volodin A. Mikhaylovich, Engels Str. 41/8/18, 390010 Kurgan Ryazan, Russian Federation

[21] Appl. No.: 244,926

[22] PCT Filed: Jun. 2, 1993

[86] PCT No.: PCT/RU93/00125

§ 371 Date: Jun. 16, 1994

§ 102(e) Date: Jun. 16, 1994

[87] PCT Pub. No.: WO93/24255

PCT Pub. Date: Dec. 9, 1993

[30] Foreign Application Priority Data

Jun. 4, 1992 [RU] Russian Federation ..... 5045888/27

[51] Int. Cl.[6] ..... B21J 5/06

[52] U.S. Cl. ..... 72/371

[58] Field of Search ..... 72/76, 77, 371, 72/377, 404

[56] References Cited

U.S. PATENT DOCUMENTS 3,608,346 9/1971 Marciniak ..... 72/76

4,300,378 11/1981 Thiruvarudchelvan ..... 72/68

FOREIGN PATENT DOCUMENTS

| | | | |
|---|---|---|---|
| 0297312 | 4/1989 | European Pat. Off. . | |
| 393018 | 8/1973 | U.S.S.R. | 72/377 |
| 393018 | 12/1973 | U.S.S.R. | 72/377 |
| 593795 | 2/1978 | U.S.S.R. | 72/371 |
| 718206 | 2/1980 | U.S.S.R. . | |

OTHER PUBLICATIONS

Danieli & C. Officine Meccaniche S.p.A., "Automatic Forging Plants."SMS Hasenclever GmbH, "Radial Forging Machine," Dusseldorf, Germany, 3000/4/90.

Danieli, "New Forging Installations with Danieli Hydraulic Forging Machines," Oct. 15, 1987, AD/f6.

*Primary Examiner*—Lowell A. Larson
*Attorney, Agent, or Firm*—Rothwell, Figg, Ernst & Kurz

[57] ABSTRACT

Method of radial forging of blank where blank is set up in chuck head of a manipulator, swaged by at least two pairs of oppositely mounted forging tools while applying at the same time normal swaging forces created by said pairs of forging tools, and shearing force then is moved along longitudinal axis or turned around longitudinal axis while the operation of swaging of blank is accomplished simultaneously at its two portions and arranged in succession along its longitudinal axis, while shearing forces are applied at these portions in opposite directions.

9 Claims, 1 Drawing Sheet

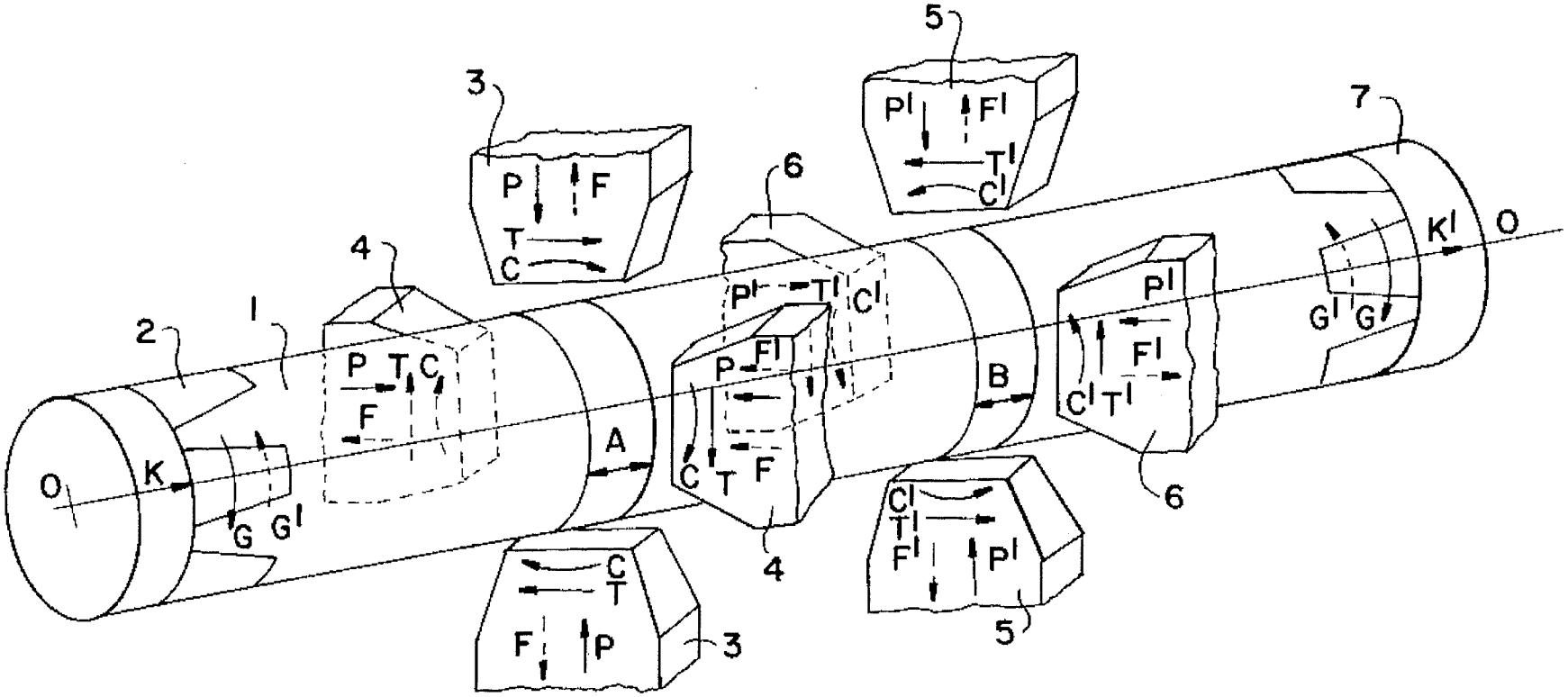
FIG. I

METHOD OF RADIAL FORGING

BACKGROUND OF THE INVENTION

1. Field of Invention

The invention pertains to the area of mechanical metal-working and deals, in particular, with a method of manufacturing long forgings from ingots and continuous cast billets.

This method can be used in machine building and metallurgy for manufacturing long products like rods, columns, shafts and so on; manufacturing pre-forged intermediate products from special, stainless, heat-resistant and hard-wrought alloys to be later worked mechanically into rods; pre-forging of long workpieces from the above mentioned alloys for subsequent mechanical dividing into uniform parts and also for forging conventionally cast ingots and continuous cast billets into deformed ones.

2. Description of the Related Art

There's known a method of radial forging of ingots and continuous cast billets with the help of a radial forging machine (see, for instance, an advertisement leaflet of "SMS" company "Radial forging machine. Advanced extrusion and forging technology". P/327. SMS Hasenclever, 3000/4/90 Sch.). By this method the initial blank is heated first, then it is set up into the chuck head of a manipulator and after that fed into the interspace of the forging tools, being simultaneously rotated for producing forgings of round cross-sections while without rotation forgings of square or rectangular cross-sections are obtained. The blank is swaged at the same part along its length in the working zone, in turn by each pair of forging tools moving radially in one plane to the blank's axis. During the intervals between swagings, when the forging tools accomplish their back travel, the blank is moved in the axial direction, when forgings of square and rectangular cross-sections should be obtained, or the blank is rotated around its longitudinal axis and moved lengthwise when forgings of round cross-sections should be obtained. The mentioned above operational cycle is repeated over and over reducing the blank to the required sizes. The considered forging method makes it possible to obtain the deformation of cast metal structure mainly in the axial zone of the forging.

However, when using the mentioned above known method of radial forging, there occasionally takes place the opening of cavities of shrink origin in ingots or continuous cast billets in their axial zones at the stage of swaging. In addition, the area reduction in the blank is 5:1. This requires an initial billet with a cross-sectional area five times larger than the cross-sectional area of the forging.

In accordance with another method of forging ingots and continuous cast billets with the help of a radial-swaging machine (see, for instance, an advertisement leaflet of "Danieli" company "New forging installations with Danieli hydraulic forging machines", Oct. 15, 1987, AD/f6) the initial conventionally cast ingot or continuously cast billet is heated first, then it is set up into the chuck head of a manipulator and after that fed into the interspace of the forging tools, being simultaneously rotated for producing forgings of round cross-sections and fed without rotation for producing forgings of square or rectangular cross-sections. The working interspace is formed by four forging tools. The forging tools move radially in one plane toward each other to the billet's axis. In addition, the forging tools move in the same tangential direction. The mentioned forging tools swage the blank simultaneously at one portion of its length. During the intervals between swagings, when the forging tools accomplish their back travel, the blank is rotated around its longitudinal axis and moved lengthwise, for forming forgings of round cross-sections, or just moved lengthwise, for forming forgings of square and rectangular cross-sections. The mentioned above operational cycle is repeated over and over swaging the blank lengthwise to the required sizes. The considered forging method makes it possible to obtain a forging with dense metal macrostructure in its axial zone and the deformation of cast metal structure mainly in its surface zone.

However, when using the mentioned above known method of forging the forging ratio is 3:1. This requires having an initial blank with a cross-sectional area three times larger than the cross-sectional area of the forging.

Thus, none of the existing known radial forging methods give an opportunity to obtain a forging with dense metal macrostructure both in its surface and axial zones with the forging ratio less than 3:1.

SUMMARY OF THE INVENTION

The object of this invention is to create a new method of radial forging of blanks that would make it possible to obtain forged products with dense metal macrostructure in their axial zones and at the same time with uniformly deformed metal structure both in their surface and axial zones with a forging ratio less than 3:1.

This object is achieved by the fact that in a method of radial forging of blanks, where the blank after having been set up into the chuck head of a manipulator, is swaged by at least two pairs of oppositely mounted forging tools while applying normal swaging forces, created by the said pairs of forging tools, and at the same time shearing forces, then is moved along its longitudinal axis, or rotated around it and moved along the same longitudinal axis, whereupon the whole process of the blank's treatment is repeated until the desired geometric size of the forging is obtained according to the invention, the operation of swaging the blank is carried out simultaneously at least at the blank's two portions situated consecutively along its longitudinal axis while the shearing forces are applied at these portions in opposite directions.

This provides uniform deformation of the cast metal structure both in the surface and axial zones of the forging.

It is advisable to create the shearing forces by swaging the blank with two pairs of forging tools each moving in its own arc with the circumference center on the longitudinal axis of the blank while one pair of forging tools is moving in arc in one direction and the other pair in the opposite one.

This makes the metal structure denser in the axial zone of the forging.

It is possible to create the shearing force by rotating at least one blank's portion, that is out of the swaging zone, around its longitudinal axis with the help of the chuck head.

This technique permits obtaining the blank's deformation through the bigger part of its length beyond the portion directly in the swaging zone.

It is appropriate to adjust the shearing force, created by the chuck head of the manipulator, approximately comparable in magnitude with the normal swaging force, created by every pair of forging tools.

This secures the blank's deformation at the portion that is out of the swaging zone, comparable with the blank's deformation at the portion that is in the swaging zone.

It is expedient to make this rotation of the blank with the change of rotation direction of the chuck head.

This technique provides the twisting of the forging's metal fibres arranged in the same direction or in different ones in the forging's length including the case of fibres' orientation parallel to the forging's axis.

It is possible to swage the blank first with one pair of forging tools applying the shearing forces in one direction and then with the other pair applying the shearing forces in the opposite direction.

This improves the deformation of the cast metal structure in the axial zone of the forging.

Below is given a particular example describing, in accordance with the invention, a detailed description of preferred embodiments in accordance with the invention.

BRIEF DESCRIPTION OF THE DRAWINGS

FIG. 1/1 shows a general view of a cylindrical blank placed in the chuck heads of manipulators and shows swaging of the blank by at least two pairs of oppositely mounted forging tools in accordance with the invention.

DETAILED DESCRIPTION OF PREFERRED EMBODIMENTS

With reference to FIG. 1/1 the method of radial forging of blanks being patented is implemented in the following way. The initial blank (1), for instance, an ingot or continuous cast billet of a round cross-section is placed in chuck head (2) of a manipulator and then fed into the working space between two sets of forging tools (3,4 and 5,6) with every set consisting of two pairs of oppositely mounted forging tools. The blank (1) is swaged by first pair (3) and second pair (4) of forging tools at portion A while applying normal swaging force P, created by the said pairs (3 and 4), and at the same time shearing force T. The blank is simultaneously swaged by third pair (5) and fourth pair (6) of forging tools at position B, lying farther along the blank's axis 00, applying shearing force T in the opposite direction. But the number of such forging tools pairs may be more. For better understanding only four pairs of forging tools are shown on the draft. In the process of swaging of blank (1) at portions A and B there appear normal compression stresses and strains in the axial zone and likewise shearing deformation in the surface zone. At the same time as the result of applying the oppositely directed shearing forces T and T at adjacent portions A and B of blank (1) there take place large shearing strains between these two portions spreading all over the cross-section of blank (1). When forging tools (3,4 and 5,6) accomplish their back travel in the direction of arrow F and F blank (1) is moved along longitudinal axis 00 in the direction of arrow K.

When forging tools (3,4 and 5,6) accomplish their back travel in the direction of arrows F and F blank (1) can be rotated around its longitudinal axis 00 in the direction of arrow G and moved along the same longitudinal axis 00 in the direction of arrow K, whereupon the swaging of blank (1) should be kept on in the manner described above up to getting the required geometric sizes of the forging.

The shearing forces can be created by swaging blank (1) with pairs of forging tools (3,5 and 4,6) each moving in its own arc C and C' with the circumference center on the longitudinal axis 00 of blank (1) while one pair of forging tools (3 or 4) is moving in arc of the circumference in one direction and the other pair (5 or 6) in arc C' of the circumference in the opposite one. Such method of creating shearing forces gives an opportunity to provide additional macroshearing strains in blank (1) being swaged between portions A and B. The macroshearing strains make a considerable effect on deformation of cast metal structure with low forging ratios of approximately less than 2:1.

It is possible to create shearing force T by rotating at least one blank's (1) portion, that is out of swaging zone A of forging tools (3 and 4), around blank's longitudinal axis 00 with the help of chuck head (2) of manipulator. When the mentioned above portion of blank (1) is being rotated there appear torsion strains in that portion acting effectively on the cast metal structure and causing the twisting of the fibres of the metal macrostructure. If it is necessary to twist blank's (1) portion, that is between parts A and B, the mentioned operation can be done with the help of chuck head (2) at the moment when pairs of forging tools (3,4) accomplish their back travel in the direction of arrow F, or with the help of chuck head (7) at some other moment when the other pairs of forging tools (5,6) accomplish their back travel in the direction of arrow F'.

It is advisable to adjust shearing force T, created by chuck head (2) of the manipulator, approximately comparable in magnitude with normal swaging force P, created by forging tools (3 and 4). In this case, there appear torsion strains in blank (1) approximately comparable with strains arising from the normal swaging with mentioned above pairs of forging tools (3,4 and 5,6). The torsion strains take place with an almost unchanged area of the blank's cross-section. This makes possible the deformation of cast metal structure with a low forging ratio, approximately less than 2:1.

It is possible with the said turning of blank (1), done by chuck head (2) of the manipulator, to perform with the change of rotation direction of chuck head (2) following arrow G'. The indicated change of rotation direction of chuck head (2 or 7) makes it possible to create torsion strain of blank (1) in the opposite direction and, thus, to change the twisting direction of the fibres of the metal macrostructure to the opposite direction, that is following arrow G'. Such technique permits the regulation of the arrangement of the fibres in the length of blank (1) and obtaining the final direction of metal fibres in the product consistent with the action of internal stresses during product's operation. As it is known, the said internal stresses can act in different directions in the length of a forged product.

According to the method being patented it is possible first to swage blank (1) with the help of one pair of forging tools (3 or 4) applying shearing force T in one direction and then with the help of one pair of forging tools (5 or 6) applying shearing force T' in the opposite direction. This technique of applying shearing forces T and T' in opposite directions provides cumulative macroshearing strains in different directions and, thus, to act effectively on the deformation of the cast metal structure almost without a change of cross-sectional area obtained after the blank's swaging, with a minimum forging ratio less than 2:1.

If there are two manipulators, it is possible to mount the blank in chuck head (7) of the second manipulator and carry out all mentioned above operations with blank (1). This enables an increase in production output. At the same time the realization of all above described operations on blank (1) with the help of chuck head (7) of the second manipulator extends control over the fibres' arrangement pattern in the metal structure of the forging and over the anisotropy of its mechanical properties.

An example

A cylindrical pure aluminium ingot of 76 mm in diameter was set up in the chuck head of a manipulator of a radial swaging machine and swaged with two pairs of forging tools simultaneously at two portions of the ingot, each portion of 40 mm long, located one after another along the ingot's longitudinal axis. The shearing force of every pair of oppositely mounted forging tools was applied to the ingot at each portion in opposite directions. In intervals between swagings the ingot was rotated around its longitudinal axis and moved along this axis. The whole operational cycle was repeated to reduce the ingot's diameter to 56 mm. Thus, the forging ratio came approximately to 2:1. The analysis of the metal's macrostructure revealed a uniform and dense structure all over the cross-sectional area of the forging with the fibres twisted approximately through 360°.

Industrial applicability

Thus, the claimed method of radial forging of blanks provides a uniform and dense metal structure all over the cross-sectional area of the blank with a insignificant forging ratio of approximately 2:1.

The application of the claimed method of radial forging of blank enables an essential increase in swaging production output, considerable reduction in power consumption and using initial blanks of smaller cross-sections.

It is quite obvious that using initial blanks of smaller cross-sections according to the claimed method of radial forging of blanks costs considerably, less than in case of using large blanks.

Apart from the increase in swaging production output the claimed method makes it possible to obtain high quality deformation of metal structure. As a result, a substantial improvement of the mechanical properties of the metal is obtained which is not possible with the use of other known methods of radial forging of blanks with low forging ratios of approximately 2:1.

We claim:

1. A method of radial forging blanks including the steps of:

a) affixing a blank in a chuck head of a manipulator;

b) simultaneously swaging said blank by at least two pairs of oppositely mounted forging tools, said pairs aligned adjacent one another along the longitudinal axis of the blank and said pairs applying normal swaging forces and shearing forces at first and second portions of the blank, respectively, said shearing forces being opposite to one another in direction; and c) moving said blank along its longitudinal axis.

2. A method of radial forging blanks including the steps of:

a) affixing a blank in a chuck head of a manipulator;

b) simultaneously swaging said blank by at least two pairs of oppositely mounted forging tools, said pairs aligned adjacent one another along the longitudinal axis of the blank and said pairs applying normal swaging forces and shearing forces at first and second portions of the blank, respectively, said shearing forces being opposite to one another in direction; and c) rotating said blank around its longitudinal axis and moving said blank along its longitudinal axis.

3. A method according to claim 1 or claim 2 wherein the shearing forces applied at first and second portions of the blank are created by swaging the blank with at least said two pairs of oppositely mounted forging tools, one of said pairs moving in an arc of the circumference of the blank while simultaneously, the other of said pairs moves in an arc of the circumference of the blank in the opposite direction.

4. A method according to claim 1 or claim 2 wherein the shearing forces applied at first and second portions of the blank are created by employing the chuck head to rotate, around the longitudinal axis of the blank, a portion of the blank which lies outside of a portion of the blank being swaged.

5. A method according to claim 4 wherein said shearing forces are fixed approximately comparable in value with the normal swaging forces.

6. A method according to claim 4 wherein said rotation of a portion of the blank is accomplished along with a change of rotation of direction of the chuck head.

7. A method of radial forging blanks including the steps of:

a) affixing a blank in a chuck head of a manipulator;

b) swaging the blank by at least a first pair of oppositely mounted forging tools applying shearing forces to a first portion of said blank in one direction;

c) swaging the blank by at least a second pair of oppositely mounted forging tools applying shearing forces to a second portion of the blank in a direction opposite to the shearing forces applied by said first pair; and d) moving said blank along its longitudinal axis.

8. A method of radial forging blanks according to claim 7 wherein step d) includes rotating said blank around its longitudinal axis.

9. A method of radial forging blanks according to claim 7 wherein after the blank is swaged by at least a first pair of oppositely mounted forging tools applying shearing forces to a first portion of said blank in one direction, the blank is then swaged by at least a second pair of oppositely mounted forging tools applying shearing forces to a second portion of the blank in a direction opposite to the shearing forces applied by said first pair.

* * * * *

UNITED STATES PATENT AND TRADEMARK OFFICE

CERTIFICATE OF CORRECTION

PATENT NO. : 5,542,278

DATED : August 6, 1996

INVENTOR(S) : Tjurin V. Aleksandrovich et al.

It is certified that error appears in the above-indentified patent and that said Letters Patent is hereby corrected as shown below:

Title page, item [57],
In the Abstract: Line 5, after "force" insert a comma;
Column 2, line 39, "obtained according" should be --obtained. According--.

Signed and Sealed this

Twenty-first Day of January, 1997

*Attest:*

*Attesting Officer*

BRUCE LEHMAN

*Commissioner of Patents and Trademarks*